US007847700B2

(12) United States Patent
Conforti

(10) Patent No.: US 7,847,700 B2
(45) Date of Patent: Dec. 7, 2010

(54) SYSTEM AND METHOD FOR AN OPTICAL PARTICLE DETECTOR

(76) Inventor: Fred J. Conforti, 2101 Lillian Ct., Lisle, IL (US) 60532

( * ) Notice: Subject to any disclaimer, the term of this patent is extended or adjusted under 35 U.S.C. 154(b) by 471 days.

(21) Appl. No.: 11/825,291

(22) Filed: Jul. 3, 2007

(65) Prior Publication Data

US 2009/0009345 A1 Jan. 8, 2009

(51) Int. Cl.
*G08B 17/10* (2006.01)

(52) U.S. Cl. ..... 340/630; 356/432; 250/221; 250/222.2

(58) Field of Classification Search ..... 340/627, 340/628, 630, 584; 356/432, 437, 438, 441, 356/442; 250/216, 221, 222.2
See application file for complete search history.

(56) References Cited

U.S. PATENT DOCUMENTS 3,335,285 A * 8/1967 Gally, Jr. et al. ..... 250/221
3,982,130 A 9/1976 Trumble
3,994,603 A 11/1976 Paschedag
4,127,329 A * 11/1978 Chang et al. ..... 356/301
4,166,960 A 9/1979 Meili
4,175,865 A * 11/1979 Horvath et al. ..... 356/338
4,181,439 A 1/1980 Tresch et al.
4,271,123 A * 6/1981 Curry et al. ..... 422/64
5,231,378 A 7/1993 Dennis et al.
5,293,049 A 3/1994 Morey et al.
5,467,189 A * 11/1995 Kreikebaum et al. ..... 356/336
5,617,077 A 4/1997 Wiemeyer et al.
5,659,292 A 8/1997 Tice
5,764,142 A 6/1998 Anderson et al.
5,926,098 A 7/1999 Wiemeyer et al.
6,091,494 A * 7/2000 Kreikebaum ..... 356/336
6,150,935 A 11/2000 Anderson
6,166,648 A 12/2000 Wiemeyer et al.
6,184,537 B1 2/2001 Knox et al.
6,239,710 B1 5/2001 Oppelt
6,445,292 B1 9/2002 Jen et al.
6,521,907 B1 2/2003 Shoaff et al.
6,876,305 B2 4/2005 Kadwell et al.
6,965,240 B1 11/2005 Litton et al.
7,075,445 B2 7/2006 Booth et al.
7,075,646 B2 7/2006 Cole
7,167,099 B2 1/2007 Kadwell et al.

* cited by examiner

*Primary Examiner*—George A Bugg
*Assistant Examiner*—Edny Labbees
(74) *Attorney, Agent, or Firm*—McAndrews, Held & Malloy, Ltd.

(57) ABSTRACT

A system and method is provided for an improved sensor for detecting particles in air such as smoke particles from a fire. The detector includes a laser diode that generates a light beam that is spread by a lens to fill a specific area of the interior of a sensing chamber before entering into a light trap for extinction. The detector consequently has a better signal to noise ratio and therefore may be more sensitive than prior art detectors. The detector may also use a shorter wavelength laser to allow the detector to sense smaller particles than prior detectors and consequently provide faster response to flaming fires.

25 Claims, 4 Drawing Sheets

SYSTEM AND METHOD FOR AN OPTICAL PARTICLE DETECTOR

BACKGROUND OF THE INVENTION

The present invention generally relates to a detector chamber. More particularly, the present invention relates to a detector chamber for use in a smoke alarm.

Fires may start in many ways and may burn with differing characteristics. For example, a fire may be lit by a match, may flame quickly, and may constantly build in size. Alternatively, a fire may be started by overheating which may smolder for hours, if not days, to build up enough heat to ignite. In either scenario, the fire emits certain signature materials to a greater or lesser degree. Fire detectors are typically designed to sense one or more of these signature materials and sound an alarm if the signature materials are detected. Additionally, designing fire detectors to sense more than one of these signature materials may improve the ability of the fire detector to more rapidly detect fires.

More specifically, smoke, the byproduct of fire, is made up of many constituents and several of the constituents have signatures that may be sensed and used to detect the smoke and consequently the fire that produced the smoke. For example some fire detectors sense specific gases like carbon monoxide. Alternatively, some fire detectors sense the heat of the fire directly. Other fire detectors sense the particles that make up the smoke by analyzing the air flowing through the fire detector and detecting particles that are suspended in the air.

Specific types of fire detectors have advantages. For example, smoke detectors of the ionization type detect smaller particles as are found in greater abundance in flaming fires. Conversely, smoke detectors of the photoelectric optical type detect larger particles as are found in greater abundance in smoldering fires.

More particularly, photoelectric type smoke detectors typically respond to larger size particles (usually around 1.0 micron in diameter and larger) while ionization type smoke detectors respond to smaller particle sizes (usually around 1.0 micron in diameter or less). However, if an ionization detector were able to detect larger particle sizes as in smoldering type smoke or a photoelectric optical type smoke detector were able to detect smaller particle sizes as in flaming type smoke, the ability of a detector including these improvements to detect fires would be improved. This is especially important because users that are trying to protect themselves from a fire have no way of knowing how a detrimental fire may start. In order to provide this advantage, some smoke detectors combine ionization and photoelectric sensors in one smoke detector. However, such dual-mode fire detectors are quite costly.

In addition, a good smoke detector needs effective smoke entry, for example for any incipient fire with low heat to get the particles into the detection chamber.

Additionally, earlier photoelectric smoke detectors have experienced adverse effects due to the build-up of dust and dirt inside the detector. In some cases, the dust/dirt increases the background light, called noise, in the chamber which reduces the signal-to-noise ratio (SNR). Conversely, a higher SNR is more desirable because it allows particles to be more easily and reliably detected.

U.S. Pat. No. 6,876,305 to Kadwell teaches a compact particle sensor. As shown in FIG. 5, Kadwell teaches reflecting an emitted beam of light several times in the interior of a detecting chamber in order to provide a greater beam length to increase the chance that a particle will interact with a beam and be sensed by the detector. However, Kadwell suffers from the drawback that the light beam may interfere with itself where the light beams cross and that a single particle in the chamber may produce either no response if the particle does not intersect a beam or may produce a non-linear response if the particle intersects multiple beams, regions of differing beam intensity, or reflects a beam so that the beam interferes with another beam. Also the reflective surfaces may gather dust and get dirty and thereby significantly increase the noise in the chamber.

Similarly, U.S. Pat. No. 7,075,445 to Booth teaches a smoke detector having a greater effective light propagation path. As shown in FIG. 4, light is reflected in the interior of a chamber so that the light beam reflects from both walls several times in order to increase the propagation path. Booth suffers from the same drawbacks outlines above in Kadwell.

Thus, there is a long felt need for a fire/smoke detector that provides more rapid detection of all types of fires and increased reliability. Further, a single ionization detector or single photoelectric detector that may detect a wider range of particle sizes may enhance the ability of the detector to detect a fire more quickly and should be less costly than a dual ion/photo fire detector. Further, a detector that does not suffer from the drawbacks of Kadwell and Booth outlined above would be desirable.

BRIEF SUMMARY OF THE INVENTION

One or more of the embodiments of the present invention provide a photo optic type fire/smoke detector that senses smaller particles in a unique way and consequently provides a faster response time to a flaming type fire and due to its construction has an increased signal-to-noise ratio (SNR). The detector includes a laser diode that generates a light beam that is redistributed by a lens to substantially fill a specified section of the interior of a sensing chamber before extinguishing itself into a prescribed light trap. Consequently, the light distributed through the lens substantially describes a section or segment occupying the interior of the sensing chamber, but because the area of distributed light from the laser is known and controlled by design, the distributed light beam may be extinguished by a carefully designed light trap, and is therefore not reflected and consequently does not create back round light (noise) that may reduce the Signal to Noise ratio.

A photon detector, like a photodiode or phototransistor, is then located at an advantageous location within the sensing chamber to detect the light being reflected or scattered off of the smoke particles that occupy the specified section or segment of the interior of the sensing chamber.

One example of such a smoke sensing chamber is one where the laser has a lens in front of it that redistributes the light into a large planar area, flat and thin (like a coin) forming an set of defined rays that may be captured and extinguished by an annular light trap. The photon sensor may be located at an angle that is a function of the wavelength of light from the laser. The shorter the wavelength; the larger the appropriate angle from the axis that the redistributed light beams are projected may be. In the current example the light detector may be below or above the horizontal layer of beams at an appropriate angle to detect the reflected or scattered light most effectively.

DETAILED DESCRIPTION OF THE INVENTION

Figure 1A:
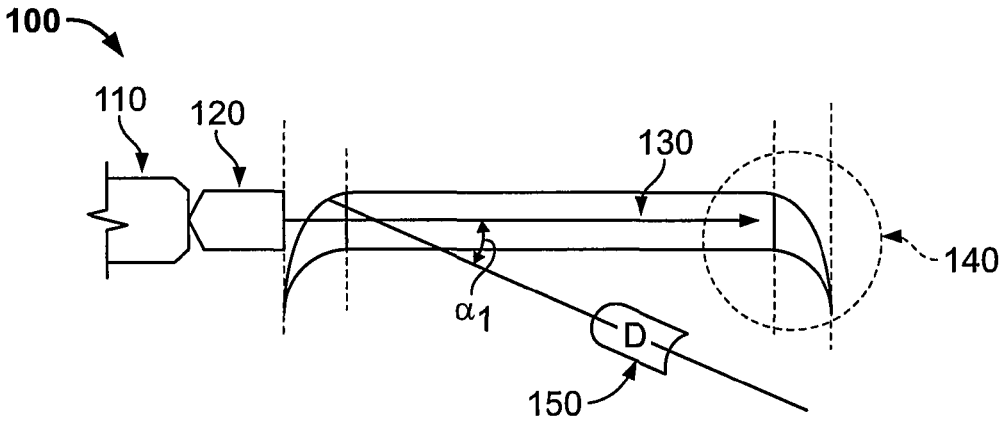
FIG. 1A illustrates a side view of an optical particle detector according to an embodiment of the present invention.

FIG. 1A illustrates a side view of an optical particle detector 100 according to an embodiment of the present invention. The optical particle detector 100 includes a collimated light generator 110, such as a laser diode, for example, a spreading lens 120, a spread, preferably planar set of light beams 130, an annular light trap 140 and a photon detector 150 set at an angle of $\alpha_1$ from the planar axis of the light. The photon detector is adapted to detect light that is scattered from or off of smoke particles entering the light beams 130. The angle $\alpha_1$ is preferably chosen to optimize the detection of light scattered from smaller particles, as further described below.

Figure 1B:
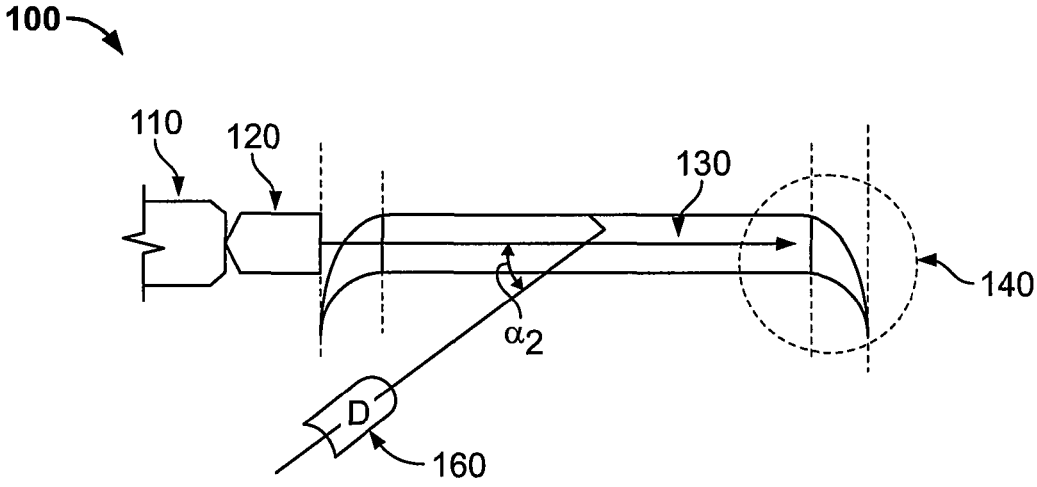
FIG. 1B illustrates a side view of the optical particle detector of FIG. 1 according to an embodiment of the present invention.

FIG. 1B illustrates a side view of the optical particle detector 100 of FIG. 1 according to an embodiment of the present invention. The optical particle detector 100 includes a collimated light generator 110, such as a laser diode, for example, a spreading lens 120, a spread, planar set of light beams 130, and an annular light trap 140, a photon detector 160 set at an angle of $\alpha_2$ from the planar axis of the light and adapted to detect light reflected from or off of smoke particles entering the light beams. The angle $\alpha_2$ is preferably chosen to be the best angle to detect the reflected light from the smaller particles.

In operation, the laser diode 110 is stimulated to generate light, typically by supplying electricity to the laser diode 110. The light generated by the laser diode 110 then impinges upon the lens 120. The lens 120 is designed to spread the light substantially in a prescribed direction(s). In one example, the spread light is directed in a plane parallel to the annular light trap 140. As the light beam emerges from the lens 120, the light beam is significantly spread in order to occupy a substantial portion of the interior of the optical particle detector 100.

Figure 2:
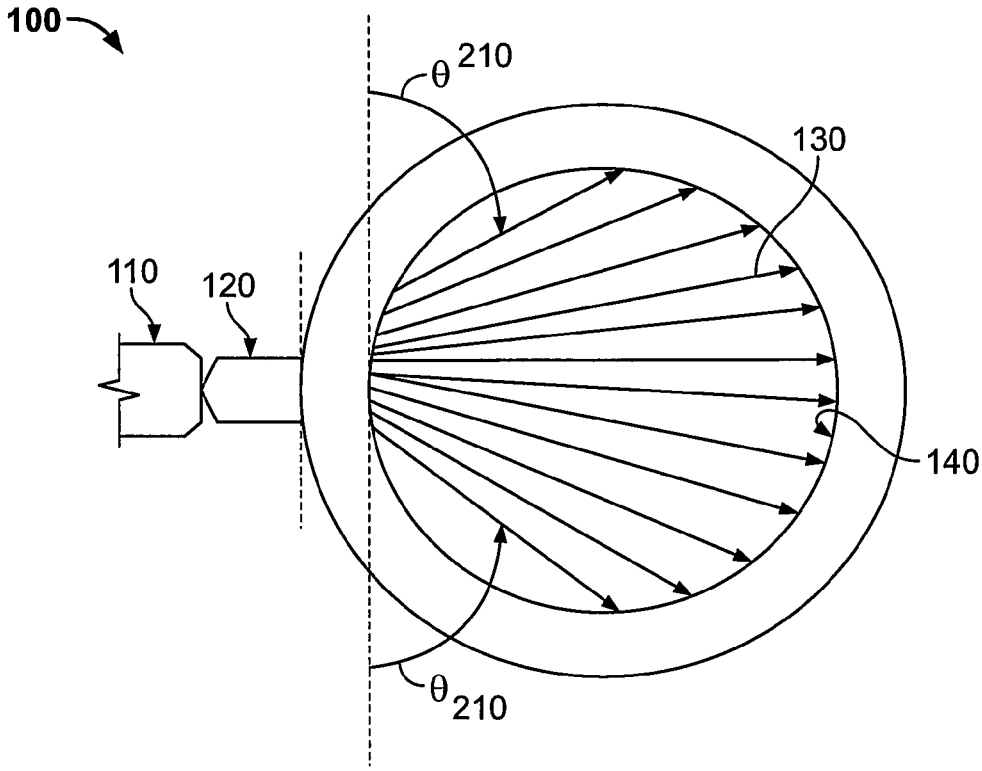
FIG. 2 illustrates a top view of the optical particle detector of FIG. 1. Angle Theta defines the width of the spread of the light beams.

The spread light beam(s) then passes through the optical particle detector 100 until the spread light beams encounters the light trap 140. The light trap 140 which is annular in the example, is positioned at the periphery of the optical particle detector 100, as shown in FIGS. 1A, 1B and FIG. 2. The light trap 140 may also be called the annular or circular light trap or the peripheral light trap.

Once the spread light beams 130 encounters the light trap 140, the light trap 140 extinguishes the spread light thereby minimizing the background light (Noise) in the optical particle detector 100.

The photon sensor 150, 160 detects the light that bounces or reflects from or off of the smoke particles that enter the beam(s) 130 within the optical particle detector 100. The position and angle of the photon sensor 150, 160 are preferably precisely controlled to maximize the received scattered or reflected light. For improved detection, the smaller the wavelength of the light source, the larger the angle may be, the smaller the particle size that may be detected. Angle $\alpha_1$ is indicated as the angle from the light beam axis (looking toward the light source) to the photon detector. The current or voltage signal that is generated by photon sensor 150 or 160 from the collection of photons that bounce off of the smoke particles, is processed to become an alarm when the level surpasses a predetermined level over a predetermined time.

FIG. 2 illustrates a top view of the optical particle detector 100 of FIGS. 1A and 1B. FIG. 2 also shows the collimated light generator 110, the spreading lens 120, the planar set of light beams 130 and the annular light trap 140. In addition, an angle θ 210 is also shown. The angle θ represents the angle from the center of the lens 120 to the typical widest spreading point of the planar set of light beams 130. As illustrated in FIG. 2, angle θ 210 is approximately 70 degrees in a preferred embodiment.

As mentioned above with regard to FIGS. 1A and 1B, the light emitted by the laser diode 110 is spread by the lens 120. The light that is spread by the lens 120 is spread so that the light occupies a substantial portion of the interior of the optical particle detector 100, as shown. In FIG. 2, the spread light 130 is illustrated by a series of rays, as is the common convention. The rays are for exemplary illustration purposes only and are not to be taken as limiting. For example, while it is preferable that the lens 120 spread the light so that the light impinges on a substantial angular portion of the interior of the annular light trap 140, the light spread θ (~70 degrees) by the lens 120 may impinge upon a greater or lesser angular section of the interior of the annular light trap than the approximately 70 degrees shown in the exemplary embodiment of FIG. 2 or it may be spread into another geometry as long as the pattern generated may be captured by a light trap that may extinguish the light.

Because the light 130 enters the light trap 140 before it is extinguished, dust or dirt film build up on the surfaces of the interior of the optical particle detector 100 or the smoke detection chamber 300 are inconsequential and light scattered off of dust or dirt film build up in the light trap are mostly recaptured. Further, because the light trap 140 is recessed and made of conductive materials, dust and dirt films are less likely to build up.

As far as it is technically feasible with available components, it is preferable that the lens 120 spread the light to produce a substantially uniform beam occupying a specific area of the interior of the optical particle detector 100. Additionally, it is most preferable that the spread light beam not only occupy a specified area of the interior of the sensing chamber, but that the intensity of the light beam be substantially constant at all angles inside the angular spread. In this fashion, the light produced by the lens 120 preferably describes an area occupying a specific portion of the interior of the sensing chamber 130 and extending from the lens 120 to the appropriate geometry light trap 140. In the example, the optical particle detector 100 is round, the spread light forms a plane of light that substantially fills an annular ring and the light trap is a bifurcated annular ring.

Figure 6:
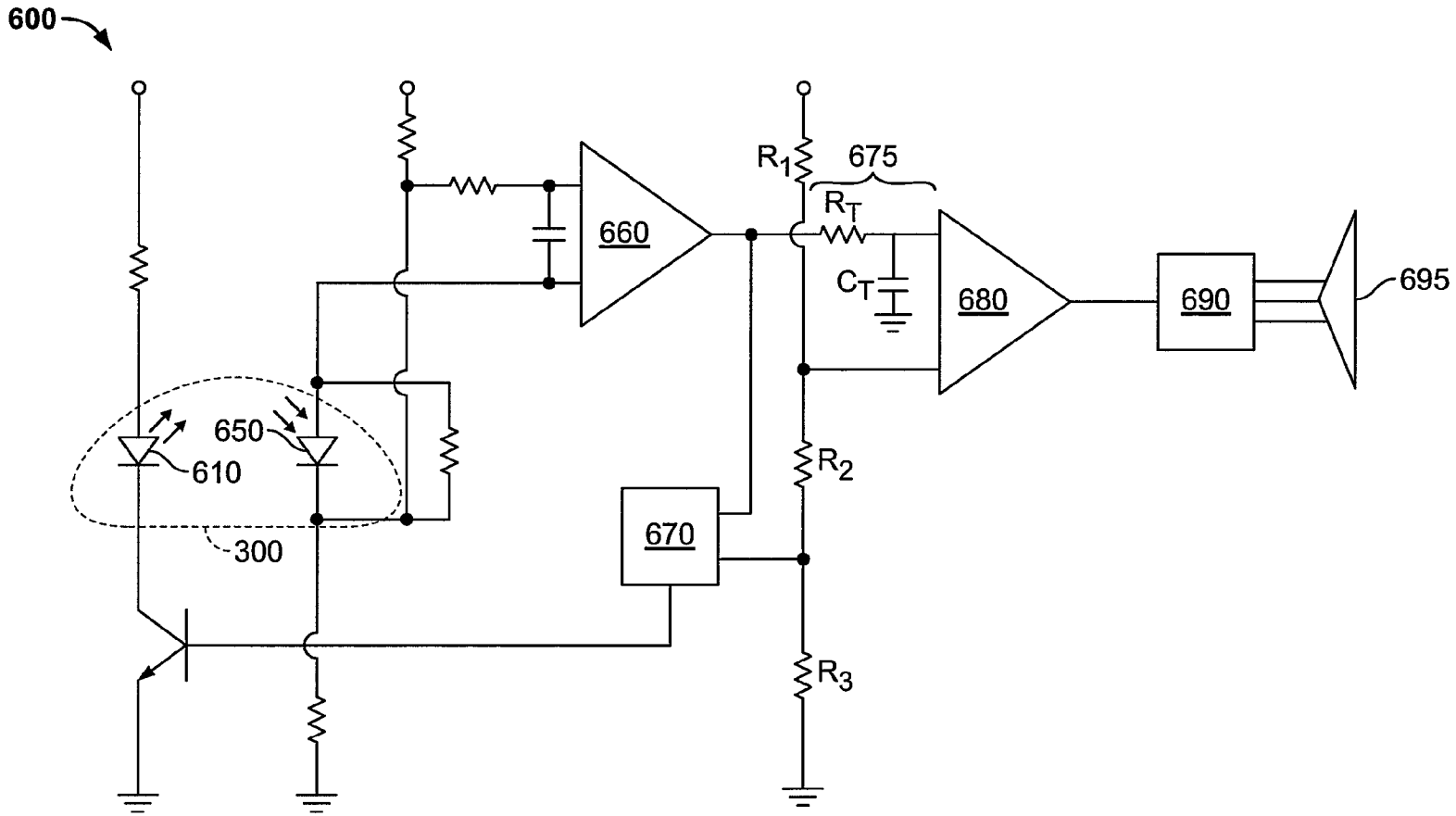
FIG. 6 is a circuit diagram of a the light detection circuitry according to an embodiment of the present invention.

In operation, any particles passing through the plane of light in the optical particle detector 100 cause interference with the plane of light as well as scattering the light and reflecting the light. Because the light coming out of the lens fills a more substantial portion of the optical particle detector 100, more light is scattered and reflected when smoke particles pass through the light beam's pattern 130. The scattered light stimulates the photon detector 150 or 160 in proportion to the amount of light that the photon detector 150 or 160 receives. This creates an increase in the current and/or voltage in the photon detector 150 or 160. This change is detected by electronic circuitry such as a comparator, for example, with a reference level set on one of its inputs with the photon detector connected to the second input that is configured to generate an alarm signal when the signal on the second input exceeds a predetermined limit. The alarm circuit then emits an audible and or a visual alarm. One such exemplary circuit is shown in FIG. 6, below.

Figure 3:
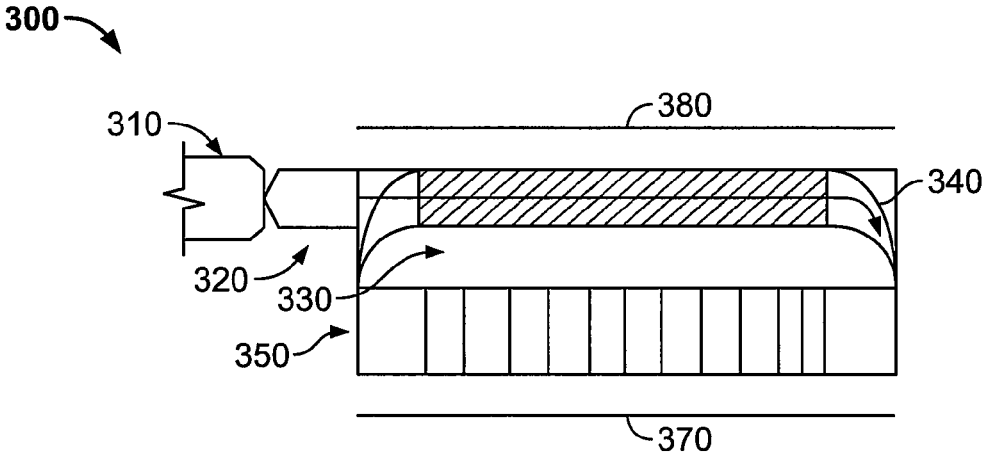
FIG. 3 illustrates a side view of a smoke detection chamber according to an embodiment of the present invention.

FIG. 3 illustrates a side view of a smoke detection chamber 300 according to an embodiment of the present invention. The smoke detection chamber 300 is based on the optical particle detector 100 of FIG. 1 and includes a laser diode 310, a lens 320, an annular light trap 340, a cylindrical fluid entry labyrinth 350, a bottom cover 370, and a top cover 380. The photon detectors 150,160 of FIG. 1 are not shown.

In FIG. 3, the laser diode 310 generates a light beam that is spread by the lens 320 into a planar formation to substantially fill a plane in the interior of the cylindrical smoke detection chamber 300 before impinging on the annular light trap 340. In operation, the fluid entry labyrinth 350 forms the outer boundary of a cylindrical smoke detection chamber 300 and may be positioned on either side, both sides or all around the outside edge of the annular light trap 340 and is designed so that air passes through the fluid entry labyrinth 350 before entering the inside of the cylindrical smoke detection chamber 300. Alternatively, instead of being positioned horizontally, as shown in FIG. 3, the cylindrical smoke detection chamber 300 may be positioned vertically or at an angle. In both of these alternatives, the fluid entry labyrinth 350 is preferably positioned so that incoming air passes through the fluid entry labyrinth 350 before entering the inside of the cylindrical smoke detection chamber 300. Other geometries may alternatively be used.

The fluid entry labyrinth 350 serves several purposes. First, the fluid entry labyrinth 350 prevents or minimizes outside light from entering the cylindrical smoke detection chamber 300. Conversely, if outside light entered the cylindrical smoke detection chamber 300, the ambient light in the sensing chamber (Noise) is likely to increase. This makes it harder to differentiate between the signal coming from smoke particles entering the sensing chamber and the ambient condition, and causes a loss in sensitivity. In a worse case, undesired light entering from outside may be intense enough to be detected by the photon detector 150, 160 and may cause a false alarm. In addition, changing levels of light outside of the sensing chamber (such as the arrival and departure of sunlight) may undesirably cause the received noise signal in the sensing chamber to fluctuate undesirably. Second, the fluid entry labyrinth 350 preferably has a bug screen (not shown) around its outside that serves to prevent large dust particles and/or insects from entering the cylindrical smoke detection chamber 300.

Figure 4:
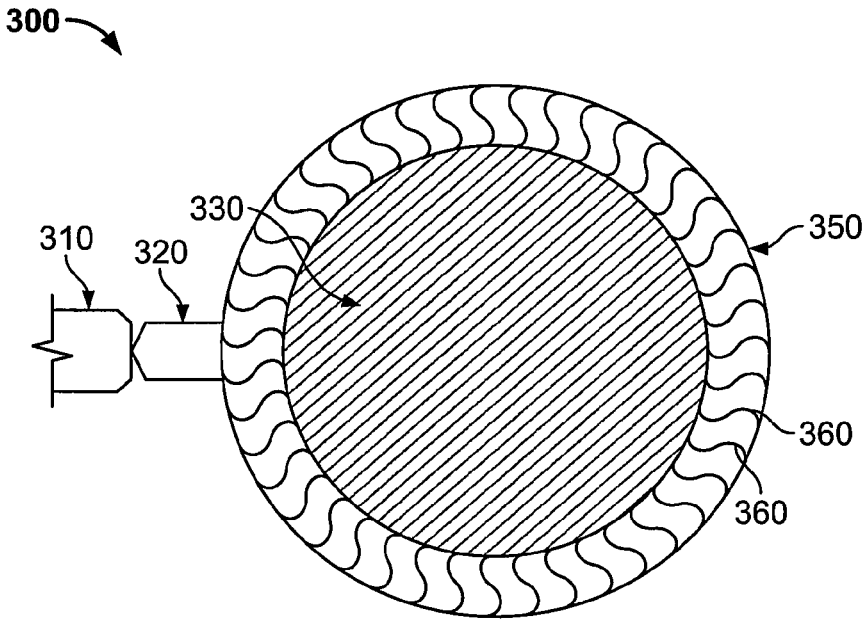
FIG. 4 illustrates a cut-away bottom view of the smoke detection chamber of FIG. 3.
Figure 5:
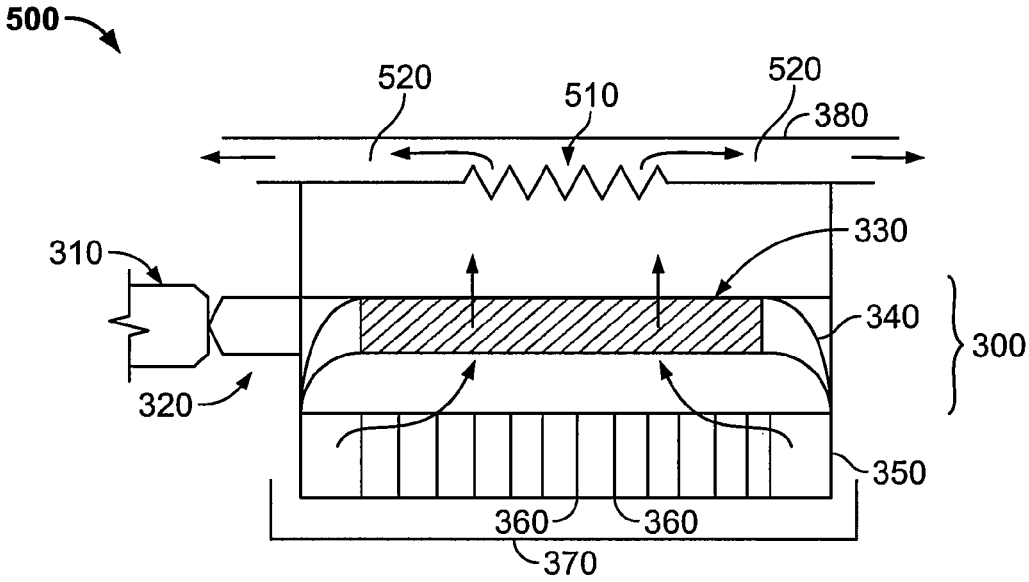
FIG. 5 is an air flow diagram showing the flow of air through the smoke detection chamber.

The cylindrical smoke detection chamber 300 components (fluid entry labyrinth 350, light trap 130, covers 370, 380) may be formed in a variety of different fashions. In one embodiment, as shown in FIGS. 3-5, the fluid entry labyrinth 350 is formed by molding plastic. The channels in the fluid entry labyrinth 350 are preferably angled or s-shaped as shown in FIG. 4, in order to minimize the amount of outside light that passes into the interior of the cylindrical segment yet allow smoke entry. In operation, air passes through the channels into the interior of the fluid entry labyrinth 350 and then passes through the light beams 130. In addition, the plastic parts are preferably conductive in order to prevent dust attraction and adherence due to static electricity.

FIG. 4 illustrates a cut-away bottom view of the smoke detection chamber 300 of FIG. 3. Also shown are the laser diode 310, the lens 320, the planar light beam area 330, and the fluid entry labyrinth 350 including the channels 360. The annular light trap 340 is obscured by the fluid entry labyrinth 350 in FIG. 4 and is consequently not shown. The photon detectors also are not shown.

In FIG. 4, the bottom cap 370 of the fluid entry labyrinth 350 has been removed to illustrate the S-shaped channels 360 passing from the outer perimeter of the fluid entry labyrinth 350 into the inner perimeter. As shown in FIG. 4, air may enter the S-shaped channels 360, from the periphery of the fluid entry labyrinth 350, pass through the fluid entry labyrinth 350, and then enter the optical particle detector 100 area.

FIG. 5 is an air flow diagram 500 using an air flow inducing element 510 showing the flow of air through the cylindrical smoke detection chamber 300. The air flow diagram includes an air flow inducing element 510, and air flow exit channels 520, in addition to the cylindrical smoke detection chamber 300. The smoke detection chamber 300 includes the laser diode 310, the lens 320, the planar light beam area 330, the annular light trap 340, the fluid entry labyrinth 350 including the channels 360, bottom cover 370 and top cover 380.

In operation, the optional air flow inducing system 510 induces air to flow into and through the cylindrical smoke detection chamber 300, past the air flow inducing system 510 and then outward through the air flow channels 520. The air flow inducing system 510 may be, for example, a heater element or a fan. Additionally, although only one air flow inducing system 510 is shown, a plurality of air flow inducing systems may be employed. Alternatively, instead of "pulling" air through the detection chamber, the air flow inducing system 510 may be positioned on the other side of the cylindrical smoke detection chamber 300 and may instead "push" air through the chamber. Further, the air need not pass through the air flow inducing system. For example, the air flow inducing system may be a heating element located on the upper planar surface of the cylindrical smoke detection chamber 300. In such a configuration, air is drawn inward through the channels 360 and passes upward over the heating element, but not through the heating element.

With regard to the air flow channels 520, although FIG. 5 illustrates two air flow channels, only a single channel may be used to provide air flow or alternatively greater number of channels or a plenum may be used.

Air flow is illustrated in FIG. 5 by arrows. As shown in FIG. 5, air enters the channels 360 at the exterior of the fluid entry labyrinth 350 and passes through the channels 360 into the interior of the fluid entry labyrinth 350. The air is then induced upward through the cylindrical smoke detection chamber 300 by the air flow inducing system 510. Once the air has passed through the cylindrical smoke detection chamber 300, the air is ejected from the cylindrical smoke detection chamber 300 through the air flow channel(s) 520.

FIG. 6 is a circuit diagram 600 of a the light detection circuitry according to an embodiment of the present invention. FIG. 6 includes a laser 610, a photon detector 650, an amplifier 660, a microprocessor 670, a delay circuit 675, a comparator 680, a horn driver 690, and a horn 695.

In operation, light is emitted from the laser 610. The light is then reflected and/or scattered and received by the photon detector 650 when smoke enters the chamber. As mentioned above, the photon detector may be a photodiode or phototransistor, for example. The photon detector 650 generates a signal in response to the received light and the signal travels to the amplifier 660, where the signal is amplified. The output of the amplifier 660 then travels to the microprocessor 670 and, after passing through the delay circuit 675, the comparator 680.

The microprocessor 670 controls the reference voltage of the comparator. The microprocessor 670 may vary the reference voltage to compensate for various artifacts such as dirt build-up over time in the smoke chamber. The microprocessor also pulses the laser 610 periodically.

The comparator 680 has its reference voltage impacted by the resistors R1, R2, and R3. The comparator compares the signal from the output of the amplifier 660 after passing through the delay circuit 675 with the signal on its other input and generates an output signal in response. The delay circuit 675 introduces a time delay prior to the signal from the amplifier 660 entering the comparator 680 so that the microprocessor 670 may have sufficient time to adjust the signal on the comparator's other input.

When the comparator's output signal exceeds a preset limit, a horn driver 690 is initiated and an audible alarm is generated through the horn 695.

If the output of the comparator 660, varies too quickly (which may indicate a bug crossing the light beams, for example) or very slowly over weeks or months (which may indicate a build-up of noise in the chamber due to dust or dirt build-up), the microprocessor 670 modifies the inputs of the comparator 680 to compensate. That is, the microprocessor 670 may preferably recalibrate the comparator's alarm reference level based on algorithms for compensating for non-smoke caused shifts in the output of the sensing photon detector 650.

Although the above Figures have described various embodiments of the invention using an exemplary installation of the detection chamber installed in a standard air environment and used in detecting smoke, the detection chamber may be positioned in a variety of environments, such as other fluid or gaseous environments, and may be used to detect the presence of other small particulates.

In other words, one or more embodiments of the present invention relate to the detection of particles in a fluid using a laser whose light which is controlled with optical component (s) within a housing to traverse a specified volume impinging on a defined section of the housing and be trapped to extinction outside of the defined section. The housing provides a chamber within which the specified volume is contained and includes an opening or openings to allow particles carried in the fluid to enter the chamber while preventing light from entering the chamber. Detection of the particles is made by a light detector, which is positioned to monitor the specified volume. One improvement provided is the ability of this optical detector to detect, with more sensitivity and a higher signal to noise ratio and more immunity to dust and dirt film build up within a smoke detection chamber and detect smaller particles than provided by the prior art detectors.

Further, one or more embodiments of the present invention relate to the detection of particles, usually smoke, that are suspended in a fluid, usually air, that are desirable to detect as quickly as possible as a warning of a potentially dangerous fire. Thus, the detector includes an optional air flow inducing element to increase the speed with which the smoke particles may enter the smoke detection chamber to provide more rapid detection of particles.

The smoke detection chamber 300 shown above improves the reliability of detection over the prior art by providing an improved signal-to-noise ratio (SNR) within the sensing chamber. The improved SNR results from several reasons. First, the Noise of the SNR is minimized because the presence of outside light is eliminated by the fluid entry labyrinth 350. Second, the Noise is minimized because the light generated within the smoke detection chamber may be extremely controlled and is extinguished by a light trap. On the other hand the Signal is increased by having more laser light in a controlled, larger area of the optical particle detector and the photon detector is selected for characteristics that enable it to monitor the prescribed light beam(s)/area. Consequently, a greater number of particles are present in the spread light beam(s) giving more signal than may be gotten from a single Laser beam of light. If the optional air flow inducing element is used, smoke enters the smoke detection chamber more quickly allowing for an earlier alarm. Third, the reliability of detection is improved because the photon sensor may be adapted to the slow increase of Noise inside the chamber due to the buildup of dust or dirt as further described below.

Another benefit provided by one or more embodiments of the present invention is that the range of particle sizes detectable by an optical particle detector is increased. More specifically, the range of particle sizes is increased because the detection chamber preferably uses a laser diode operating at a small wavelength like blue or ultraviolet with wavelengths near 400 nm. The smaller wavelengths of the light emitted by the laser diode allows the detection of smaller particles compared to current designs which typically use infrared light sources with wavelengths near 900 nm. For example, the detection chamber may preferably use a violet laser diode at about 400 nm which allows particles smaller than 1.0 microns to be detected. Alternatively, ultra-violet or blue lasers may be employed. The particles may be detected using scattering and/or reflection. Because the detector is able to detect smaller particles, the detector is able to detect some flaming type fires more quickly.

Additionally, because the detector employs a laser as the light source, the light source is brighter, yet easier to control than the LED light sources used in most current photoelectric smoke detectors. For example, the laser may be directed to where it may be controlled or extinguished in order to minimize background noise in a way that previous photonic sources could not. More specifically, previous photoelectric smoke detectors used collimating lenses to control (narrow) the light from bulbs or LEDs. The collimating lenses were needed to make the spectral output of the light source cone shaped. Light from the non-laser source spread in random directions making entrapment and complete extinguishment practically impossible. The lenses in the previous systems focused the light more narrowly making it somewhat easier to control, but were not able to meet the extinction performance characteristics of a laser-based system.

Conversely, in the present detector, the lens broadens the laser light instead of the prior art lens narrowing light emitted from a bulb or LED. In the present detector, because a laser has a coherent, in phase, very narrow light beam, if the beam were not broadened by the lens, then there would be little noise in a chamber but there would also be very little signal from smoke entering the beam because the smoke would have to interfere with the single, narrow laser beam. Additionally, the collimated light generated by the laser is preferably at a short wavelength such as ultraviolet at about 400 nm.

Conversely, the present detector spreads the laser light beam into multiple coherent beams to get an improved signal response when smoke enters the spread beam(s). Additionally, because the laser is coherent and single phase, the light may be split or spread in a very precise manner allowing for the precise extinction of the spread beam(s) in the light trap design. Thus, the light reflected or scattered off of the particles in the sensing area is more easily detected.

Further, the light sensing 650 and signal processing electronics 690 preferably include a system for compensating for dust, dirt, or film build-up during operation of the detector. For example, the build-up of dirt and dust on the inner surface of the smoke detection chamber 300 may cause the light Noise provided to the light sensor 650 to increase very slowly over time. In the extreme case, the increased Noise may reach the alarm level and may cause the circuit to erroneously trigger an alarm unless the light sensing electronics include a way to compensate for gradual Noise increases Consequently, in one exemplary embodiment, the light analysis electronics may include a microprocessor 694 and an algorithm that is responsive to the sensed light signal over a long time period in order to regularly adjust the reference noise level or the sensing threshold of the comparator to prevent erroneous alarms. For example, the light sensing electronics may sample the Noise level daily and use the average of the last several days as the new baseline for the Noise level reference. The alarm level would be a fixed amount of light signal above the last reference noise level.

When a bug transverses the light beam(s) a rather immediate increase or decrease of signal is generated from the photon detector 630. This does not happen when smoke enters the chamber and therefore this rapid change may be programmed to be ignored for a predetermined period of time. Thus, the improved smoke detection chamber has increased sensitivity, an improved signal to noise ratio, is more reliable and has the ability to discriminate between dust, dirt and film build-up and smoke. Further, the present detector is suitable for use in many types of smoke detectors including ceiling or wall mounted detectors or duct detectors.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. A system for detecting particles in air, the system including:

a light generator producing a collimated beam of light;

a lens spreading said collimated beam of light;

a sensing chamber, wherein said light generator and said lens are positioned on the periphery of said sensing chamber and spread said collimated beam of light to form a substantially planar beam of light to substantially fill a prescribed area of the interior of said sensing chamber;

a light trap positioned in the interior of said sensing chamber, wherein said spread beam of light is received into said light trap and extinguished, wherein said light trap extends angularly around a substantial portion of the interior of said sensing chamber, wherein said light trap receives light that has been angularly diverted by said lens to an angle other than that described by said collimated beam of light; and a photon sensor placed within said sensing chamber to detect light scattered or reflected from airborne particles entering said chamber.

2. The system of claim 1 wherein said collimated light generator is a laser diode.

3. The system of claim 1 wherein the collimated light is produced by a lased diode at a wavelength from blue to ultraviolet.

4. The system of claim 1 wherein said lens spreads said collimated beam of light to form a substantially planar light beam.

5. The system of claim 1 wherein said collimated beam of light is not reflected from a wall inside said sensing chamber.

6. The system of claim 1 wherein said light trap is annular.

7. The system of claim 1 further including a fluid entry labyrinth wherein air entering the sensing chamber first passes through at least one channel in said fluid entry labyrinth.

8. The system of claim 1 further including an air flow inducing system that induces air to flow into said sensing chamber.

9. A system for detecting particles in air, the system including:

a laser diode producing a beam of light;

a lens spreading said beam of light;

a sensing chamber, wherein said light generator and said lens are positioned on the periphery of said sensing chamber and spread said beam of light to form a substantially planar beam of light in the interior of said sensing chamber;

a light trap positioned in the interior of said sensing chamber and at least partially surrounding said sensing chamber, wherein said substantially planar beam of light is received into said light trap, wherein said light trap receives light that has been angularly diverted by said lens to an angle other than that described by said collimated beam of light; and a photon detector located in or on the sensing chamber and positioned to detect light scattered or reflected from particles in the air.

10. The system of claim 9 wherein the collimated light is produced by a lased diode at a wavelength from blue to ultraviolet.

11. The system of claim 9 wherein said light provides a signal indicative of whether at least one particle has entered the planar beam of light.

12. The system of claim 9 wherein said substantially planar beam of light is not reflected from a wall inside said sensing chamber.

13. The system of claim 9 wherein said light trap is annular.

14. The system of claim 9 further including a fluid entry labyrinth wherein air entering the sensing chamber first passes through at least one channel in said fluid entry labyrinth.

15. The system of claim 9 further including an air flow inducing system that induces air to flow into said sensing chamber.

16. The system of claim 15 wherein said air flow inducing system is at least one of a fan and a heating element.

17. The system of claim 9 wherein said light trap surrounds said sensing chamber except for where said substantially planar beam of light is introduced into said sensing chamber.

18. A method for detecting particles in air, said method including:

producing a beam of light using a laser diode;

spreading said beam of light using a lens to form a substantially planar beam of light, wherein said laser diode and said lens are positioned on the periphery of a sensing chamber;

projecting said substantially planar beam of light into the interior of said sensing chamber;

receiving said substantially planar beam of light using a light trap positioned at least partially around the perimeter of said sensing chamber, wherein said light trap extends angularly around a substantial portion of the interior of said sensing chamber, wherein said light trap receives light that has been angularly diverted by said lens to an angle other than that described by the beam of light produced by said laser diode; and determining when at least one particle has interacted with said substantially planar beam of light by analyzing the power of the light reflected from the at least one particle in the planar beam of light when received at a photon detector positioned to monitor light scattered or reflected from the beam of light.

19. The system of claim 18 wherein the collimated light is produced by a lased diode at a wavelength from blue to ultraviolet.

20. The method of claim 18 wherein said substantially planar beam of light is not reflected from a wall inside said sensing chamber.

21. The method of claim 18 wherein said light trap is annular.

22. The method of claim 18 further including passing air through at least one channel of a fluid entry labyrinth before allowing air to enter said sensing chamber.

23. The method of claim 18 further including inducing air to flow in said sensing chamber.

24. The method of claim 20 wherein air is induced to flow using at least one of a fan and a heating element.

25. The method of claim 18 wherein said light trap surrounds said sensing chamber except for where said substantially planar beam of light is introduced into said sensing chamber.

* * * * *